US005653140A

United States Patent [19]

West

[11] Patent Number: 5,653,140

[45] Date of Patent: Aug. 5, 1997

[54] LIGHTWEIGHT PNEUMATIC HOG RING GUN

[76] Inventor: Robert J. West, 752 Hallowell Rd., Pownal, Me. 04069

[21] Appl. No.: 586,963

[22] Filed: Jan. 16, 1996

Related U.S. Application Data

[63] Continuation-in-part of Ser. No. 388,396, Feb. 14, 1995, Pat. No. 5,483,815.

[51] Int. Cl.[6] ..... B21J 9/18; B21D 7/06; B21F 45/16

[52] U.S. Cl. ..... 72/409.02; 72/409.1; 72/407; 72/453.15; 72/452.8

[58] Field of Search ..... 72/452.8, 452.9, 72/409.02, 409.03, 409.05, 409.1, 453.15, 407, 453.16

[56] References Cited

U.S. PATENT DOCUMENTS

| | | | |
|---|---|---|---|
| 3,015,824 | 1/1962 | Richardson | 72/453.15 |
| 3,537,293 | 11/1970 | Gerlach | 72/453.16 |
| 3,628,230 | 12/1971 | Grise | 72/409.02 |
| 3,830,089 | 8/1974 | Boyd et al. | 72/407 |
| 4,890,474 | 1/1990 | Agostini et al. | 72/453.16 |
| 5,123,273 | 6/1992 | Kawabata | 72/409 |
| 5,483,815 | 1/1996 | West | 72/453.15 |

*Primary Examiner*—David Jones

*Attorney, Agent, or Firm*—William Nitkin

[57] ABSTRACT

A lightweight pneumatic hog ring gun utilizing a pair of pivoting jaws to catch and retain a hog ring for application when a power wedge spreads the rear of the jaws apart, clinching the hog ring, with a lock piston that retains tension on the rear of the jaws before spread by the power wedge to aid in retention of the hog ring. The pneumatic hog ring gun also includes an improved air pressure control mechanism and a shorter, lightweight main piston chamber formed within its frame.

3 Claims, 3 Drawing Sheets

LIGHTWEIGHT PNEUMATIC HOG RING GUN

This application is a continuation-in-part of my previous application entitled Pneumatic Hog Ring Gun filed Feb. 14, 1995 Ser. No. 08/388,396 now U.S. Pat. No. 5,483,815.

BACKGROUND OF THE INVENTION

1. Field of the Invention

This invention resides in the area of tools for applying hog rings and more particularly relates to a pneumatically operated hog ring gun.

2. Description of the Prior Art

Prior art tools for applying hog rings have generally been heavy, large and unwieldy, providing for often difficult and uncomfortable use. These attributes can lead to fatigue and lower productivity for workers having to use such tools throughout a work day. Such tools must often be supported by cables running through overhead pulleys to counterweights to help reduce the weight of the tool that the operator must manipulate.

SUMMARY OF THE INVENTION

The pneumatic hog ring gun of this invention has a pistol shape and is relatively small, lightweight and easy to operate.

One of the main objects of the present invention is to provide a lightweight pneumatic hog ring gun which incorporates its piston within its frame structure without the requirement of a separate cylinder.

The present invention includes a pair of jaws for clinching hog rings and a lock piston that extends out of the lock piston chamber of the framework and wedges the rear of the jaws apart. By such action, the lock piston forces the jaws to hold a hog ring firmly therebetween, yet does not cause the jaws to prematurely clinch the hog ring. The lock piston, therefore, allows the hog ring to be used to pull workpieces together while being held firmly between the jaws.

The present invention also includes a hog ring feed bar for holding and individually dispensing hog rings into position between the jaws. The feed bar is relatively simple and includes a free end for loading the hog rings thereon, making loading quick and easy.

Yet another object of the present invention is to provide a pneumatic hog ring gun that is quieter and more comfortable to use, being shorter and much lighter in weight than prior art hog ring guns. This object is achieved by providing a cover that fits over most of the structure. The cover, made from thick, rubber-like material similar to that used in wet suits such as Neoprene, muffles the compressed air escaping from the gun, thereby reducing noise. In addition, the cover provides for user comfort by insulating the user's hand against the cold and by cushioning the user's hand from the vibration of the gun.

DESCRIPTION OF THE PREFERRED EMBODIMENT(S)

Figure 1:
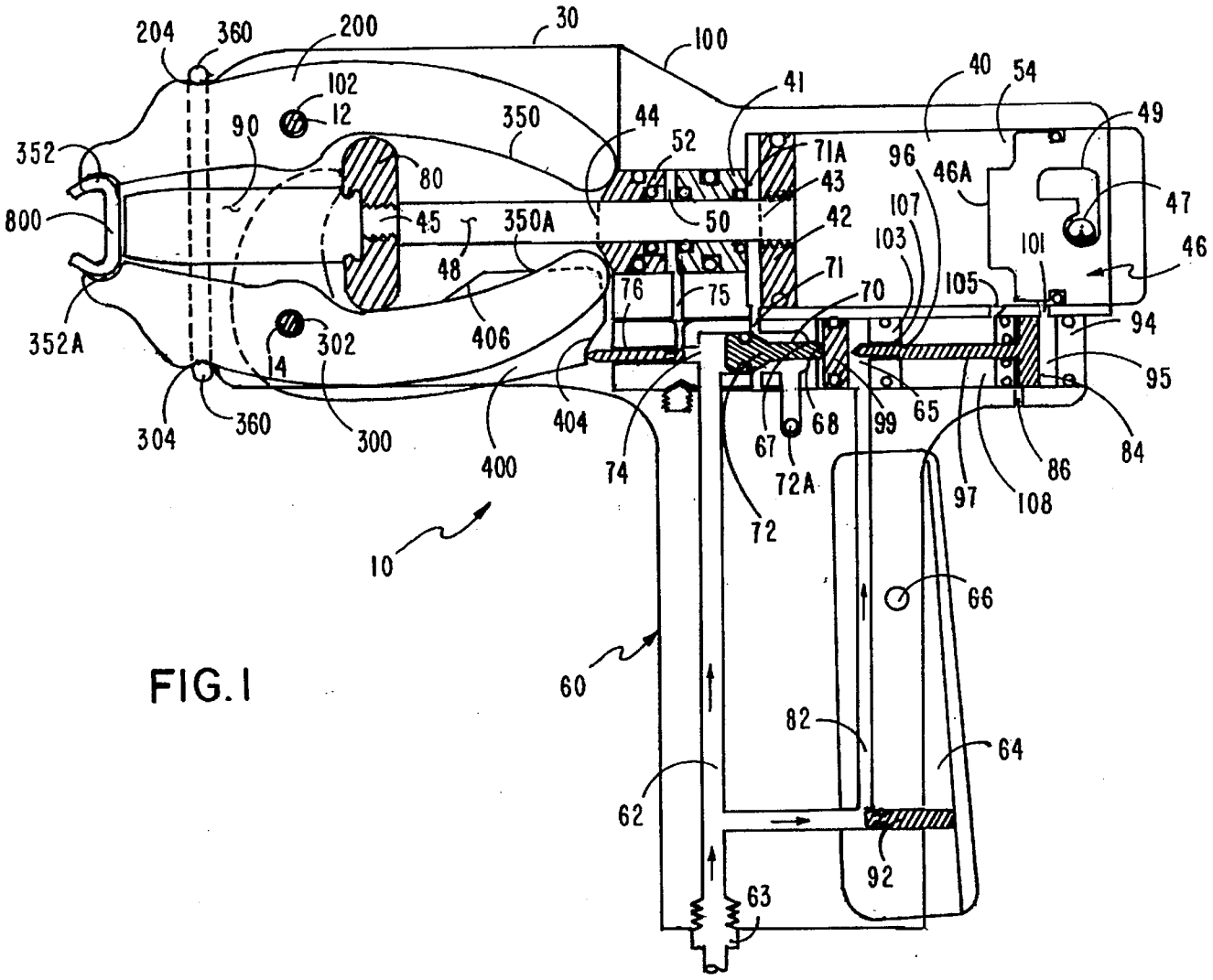
FIG. 1 illustrates a sectional side elevational view of the lightweight pneumatic hog ring gun of this invention.

A preferred embodiment of the improved lightweight pneumatic hog ring gun 10 is seen in FIG. 1 which includes handle 60, main piston chamber 40, power wedge 80, feed blade 90, frame 100, upper jaw 200, lower jaw 300, and lock piston valve actuator lever 400. The feed bar is not seen in this view. Frame 100 includes two, generally air-tight chambers defined therein: main piston chamber 40 and lock piston chamber 50 with baffle 41 therebetween. Lock piston chamber 50 contains lock piston 52, while main piston chamber 40 contains main piston 42. As seen in FIG. 1, air pressure has biased main piston 42 towards the front of main piston chamber 40 when trigger 64 is not actuated. Adjustable stop member 46, extending out of the back of main piston chamber 40, can be adjusted in depth therein by movement first inward and then with rotational movement to move pin 47 within slot 49 which pin positions adjustable stop member 46 at a first and a second position to stop the rearward movement of main piston 42 at such two different positions in main piston chamber 40, thereby adjusting the distance main piston 42 travels. First end 43 of shaft 48 is attached to the front of main piston 42, and the shaft extends out of main piston chamber 40, through fixed baffle 41, through lock piston chamber 50 and through aperture 44 in lock piston 52.

Handle 60 contains first air line 62 with hose attachment 63 which receives a main air line from a compressed air source. First air line 62 extends into main piston valve chamber 70 and lock piston chamber air passage 74. Main piston valve chamber 70 is bisected by main piston valve 72, and lock piston chamber air passage 74 is bisected by lock piston valve 76. When main piston valve 72 is in the forward position, as shown, compressed air cannot enter main piston chamber 40 through first inlet 71 as first inlet 71 is blocked by main piston valve 72. When lock piston valve 76 is in the forward open position, as shown, compressed air can enter lock piston chamber 50 through second inlet 75, forcing lock piston 52 forward to engage and somewhat spread apart the rear ends of upper and lower jaws 200 and 300. Trigger 64 is pivotally connected at trigger pivot 66 to handle 60.

Figure 3:
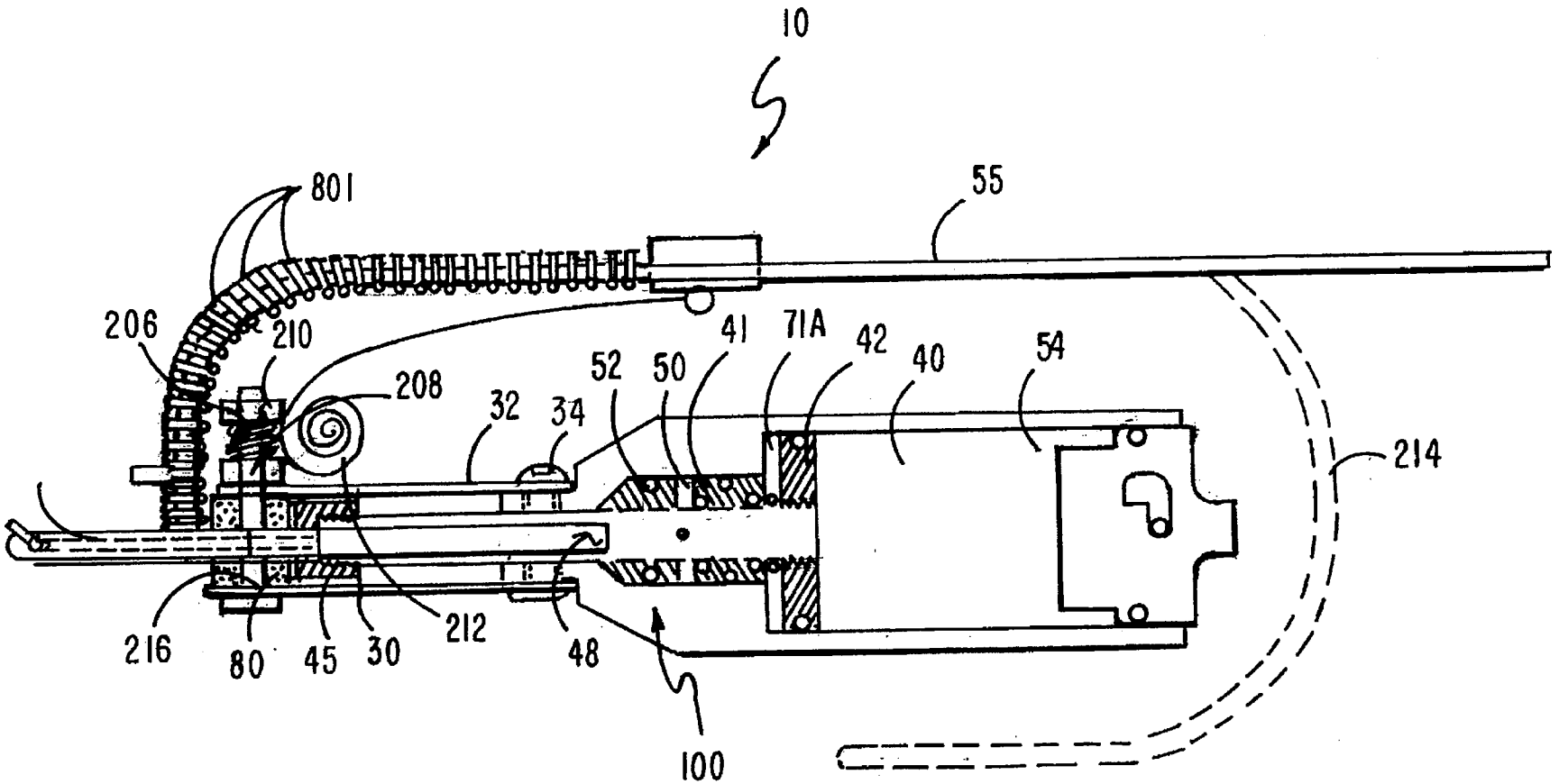
FIG. 3 illustrates a top sectional view of the hog ring gun of this invention.

Further seen in FIG. 1 is power wedge 80 which is connected to the second end 45 of shaft 48, and feed blade 90 is connected to the other side of power wedge 80. Seen in FIG. 3 are first side plate 30 and second side plate 32 which are attached at one end by bolt 34 to the front of frame 100. At the other end of first and second side plates 30 and 32 are disposed upper and lower bolt holes, such as upper bolt hole 216, through which the jaw pivot bolts, such as bolt 208, pass. Lock piston valve actuator lever 400 is pivotally connected to frame 100 by the lower pivot bolt which passes through a lever bolt hole and an aligned lower bolt hole in the side plates. Upper and lower jaws 500 and 300 are pivotally connected to first and second side plates 30 and 32 with upper and lower pivot bolts passing through aligned upper and lower jaw bolt holes 505 and 302. Jaw elastic band 360 slips over upper and lower jaws 500 and 300 and is retained in jaw elastic band seats, being upper and lower grooves 204 and 304. Jaw elastic band 360 which can be an O-ring adds a compression force to upper and lower jaws 200 and 300 and prevents upper and lower clinching surfaces 355 and **352*a*** from separating too far during operation of the device.

In operation of the device a plurality of hog rings 801 are slid onto feed bar 55 seen in FIG. 3. The feed bar can also be curved around the rear of the gun in an optional configuration 214 as seen in dashed lines in FIG. 3.

In operation, the embodiment as depicted in FIG. 1 has completed the loading of hog ring 800 between the clinching surfaces of upper and lower jaws 200 and 300, having been pushed there by the advancement of feed blade 90 as main piston 42 has been moved by air pressure to its most forward position. In this embodiment the tool is ready to be manipulated so that the items to be joined are positioned within the arms of the hog ring. In this embodiment, air travels through both first and second air lines 62 and 82 which, because lock piston valve 76 is open, first allows the air to pass through second inlet 75 into lock piston chamber 50 which action pushes lock piston 52 forward, spreading the rear portions of the jaws apart to pivot the front portions of the jaws closer together around upper and lower bolts 12 and 14 to tightly hold the hog ring in place. Main piston valve 72 is biased in main piston valve chamber 70 to block first inlet 71 by air pressure coming through second air line 82 into air receipt chamber 65 which action forces floating valve piston 99 against the rear of main piston valve 72, pushing it forward in main piston valve chamber 70 to block air from entering first inlet 71 to the main piston chamber. At the same time, the air traveling through second air line 82 passes by floating regulator valve 97 which has floating regulator valve tip 96 which is smaller at its end than the aperture in regulator valve baffle 103 which allows the air by narrower floating regulator valve tip 96 to pass up into main piston chamber 40 through inlet 105 which pressure moved main piston 42 forward. When the pressure in main piston chamber 40 reaches 10 psi or another preselected pressure level, the air pressure also increases in shutoff air chamber 95 through outlet port 101 behind floating regulator piston 84 which is attached to floating regulator valve 97, driving floating regulator valve 97 forward to a point where floating regulator valve tip 96 fills the regulator valve baffle aperture 107 in regulator valve baffle 103 to block further air pressure from entering main piston chamber 40 through inlet 105. Any excess air pressure will pass out of shutoff air chamber 95 through exhaust vent 86. In one embodiment, the gun of this invention can be run on air pressure of 100 psi which aids in driving back main piston 42 with great force for greater clinching pressure and also to adjust floating regulator valve 97 to be of a configuration to allow only a buildup of 10 psi through inlet 105 to drive main piston 42 slowly forward for low air consumption. The amount of pounds per square inch pressure for such forward movement of main piston 42 can be regulated by adjusting the difference in diameter of floating regulator valve tip 96 to the diameter of floating regulator piston 84.

Figure 2:
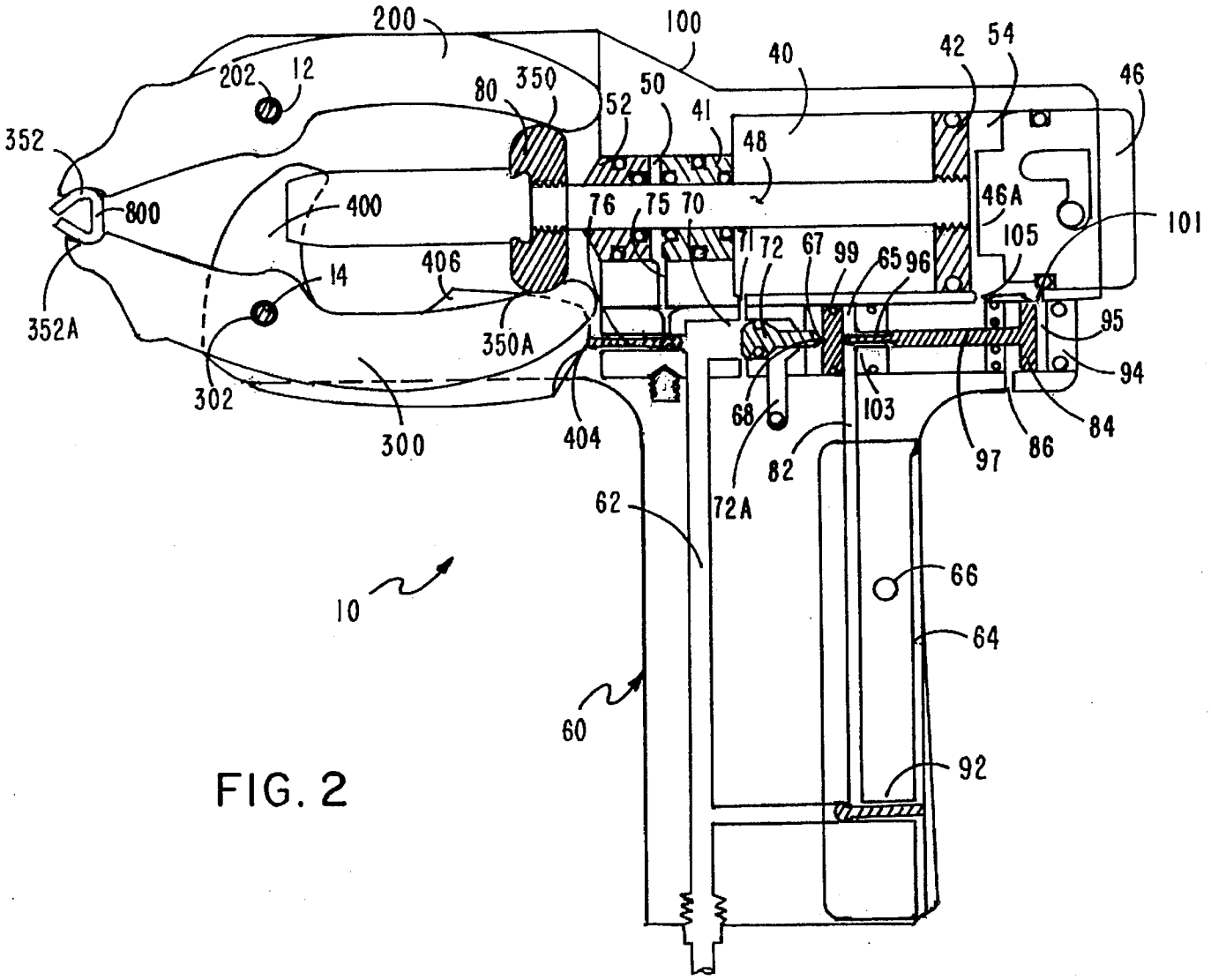
FIG. 2 illustrates the sectional side elevational view of FIG. 1 with the piston rearwardly driven to clench the hog ring.

As seen in FIG. 2, when the lower portion of trigger 64 is manually squeezed toward the front of handle 60, trigger 64 pivots about centrally located trigger pivot 66 and causes the opening of main piston valve 72 as described below. It should be noted that traditional front-located triggers can also be used with the device of this invention. Squeezing trigger 64 on the bottom portion thereof closes trigger valve 92 in second air line 82 which extends off first air line 62 within handle 60. Closed trigger valve 92 prevents air pressure from passing further up second air line 82 and exhausts air around smaller rear portion of trigger valve 92 coming from behind floating valve piston 99 and from main piston chamber 40 as main piston 42 moves rearward. When trigger valve 92 is closed, full line pressure from first air line 62 is applied to the front of main piston valve 72 which pressure pushes floating valve piston rearward to contact the end of floating regulator valve 97 which opens passageway 107 while air pressure in main piston chamber 40 behind main piston 42 in area 54 continues to exhaust past trigger valve 92. The cut off of pressure in second air line 82 reduces the air pressure within air receipt chamber 65 behind floating vlave piston 99 which, because of the great surface area of floating valve piston 99, has exerted a greater forward force on main piston valve 72 than the rearward force of the air pressure against the smaller surface of the front of main piston valve 72 in main piston valve chamber 70 heretofore keeping main piston valve 72 in its forward position. With such reduction of air pressure forces in air receipt chamber 65, the air pressure through first air line 62 then exerts greater pressure on the front portion of main piston valve 72 than at its rear, forcing main piston valve 72 and floating valve piston 99 rearward until main piston valve 72 is positioned beyond first inlet 71 within main piston valve chamber 70. Main piston valve chamber vent **72*a* allows for the venting of any air pressure behind main piston valve 72 within main piston valve chamber 70. Air pressure now can pass from first air line 62 through first inlet 71 to the area 71*a* in front of main piston 42, forcing main piston 42 rearward until it strikes the front 46*a* of adjustable stop member 46 which is engaged in the rear of main piston chamber 40. Any air pressure located behind main piston 42 will be driven out through inlet 105 and past regulator valve baffle aperture 107 and down second air line to vent around the loose fitting rear end of closed trigger valve 92. This rearward movement of main piston 42 and shaft-attached power wedge 80 forces apart the rear portions of upper and lower jaws 200 and 300 and causes the clenching of hog ring 800**.

When pressure is released on the bottom portion of trigger 64, trigger valve 92 opens and allows the passage of air pressure back through second air line 82 and ultimately to the rear of main piston chamber 40 by floating regulator valve 97 which pressure also forces floating valve piston 99 against the rear of main piston valve 72, forcing main piston valve 72 to close over first inlet 71. The air pressure then coming into main piston chamber 40 through inlet 105 then drives main piston 42 forward to its loading position, as seen in FIG. 1, with any air in area **71*a* vented out through main piston valve chamber vent 72*a*. To the rear of floating regulator valve 97 is a non-moving fixed piston 94 and a movable floating regulator piston 84 attached to the rear of floating regulator valve 97. The air pressure forces from main piston chamber 40 pass through outlet 101 which at a fixed pressure, as discussed above, moves floating regulator piston 84 and its attached floating regulator valve 97 forward to seal against aperture 107 in regulator valve baffle 103 to block further air pressure from entering main piston chamber 40 through inlet 105. When not activated, trigger 64 is held with its bottom portion at a rearward position by the air pressure in second air line 82 moving trigger valve 92 rearward which movement keeps second air line 82 open and main piston valve 72 closed by air pressure on floating valve piston 99 as seen in FIG. 1. If trigger 64 is pushed on its upper portion, the gun will not activate to clinch a hog ring. Only when the palm of the user's hand depresses the bottom portion of trigger 64 will trigger 64 pivot at trigger pivot 66, closing trigger valve 92** and allowing the gun to then activate and clinch a hog ring.

About the same time that upper and lower jaws 200 and 300 are released by the pressure release behind lock piston 52, power wedge 80 continues to be pulled towards lock piston 52 and contacts upper and lower curved surfaces 350 and **350*a* of upper and lower jaws 200 and 300. As power wedge 80 continues to move along curved surfaces 350 and 350*a*, the adjacent rear ends of upper and lower jaws 200 and 300 are forced further apart by power wedge 80; and upper and lower clinching surfaces 352 and 352*a* of upper and lower jaws 200 and 300 are forced together as upper and lower jaws 200 and 300 pivot about upper and lower bolts 12 and 14, respectively, in bolt holes 202 and 302 seen in FIGS. 1 and 2. Upper and lower clinching surfaces 352** and 352*a*, when forced together, clinch hog ring 800 held therebetween. While power wedge 80 moves rearwards, it pulls attached feed blade 90 with it. As feed blade 90 moves rearwards, it uncovers a hog ring aperture, not shown, in feed bar connector plate 106 seen in FIG. 3, allowing a hog ring to slide off the feed bar and rest in front of feed blade 90 for later advancement to the clinching surfaces of the upper and lower jaws.

As power wedge 80 moves toward lock piston 52 as seen in FIG. 2, it also contacts curved surface 406 of lock piston valve actuator lever 400, forcing lock piston valve actuator lever 400 to pivot about lower bolt 14 in lower jaw bolt hole 302. As lock piston valve actuator lever 400 pivots, valve pressure surface 404 forces lock valve 76 rearwards to close second air passage 75, preventing air pressure from entering lock piston chamber 50 and venting air pressure in lock piston chamber 50 by allowing such air pressure to exhaust around the loose fitting front of lock piston valve 76 and allowing lock piston 52 to move rearwards and release pressure on the rear ends of the jaws. When lock valve 76 is open, it allows air pressure to re-enter lock piston chamber 50 and force lock piston 52 forward. As lock piston 52 moves forward, it contacts the ends of upper and lower jaws 200 and 300, forcing the ends apart and moving upper and lower clinching surfaces 352 and 352*a* toward one another. Lock piston 52, therefore, helps create a positive lock to cause upper and lower jaws 200 and 300 to securely hold hog ring 800 in position between upper and lower clinching surfaces 352 and 352*a* prior to its actually being crimped when the trigger is activated. This positive holding action allows the user to hook the opening of the hog ring onto wire or other workpiece material and pull the pieces together before crimping the hog ring. When lock piston valve 76 is closed, lock piston 52 is not forced forward by air pressure, and the rear portions of upper and lower jaws 200 and 300 are released.

When using a hog ring gun, it is often desirable to be able to push hard on the tool handle to pull wire strands or netting together at the point where the hog ring is to be applied. It is also desirable to have a gun which requires light manual force to activate the gun to clinch the hog ring. By positioning trigger pivot 66 near the middle of handle 60 and by using a small trigger valve 92, only a small amount of pressure at the bottom portion of trigger 64 and a short trigger movement are needed to activate the hog ring gun of this invention. As much palm pressure as is needed can be applied to the top portion of the trigger above trigger pivot 66 to bring the workpieces to be joined into position within the open hog ring without triggering the gun. When the user is ready to trigger the gun, a small squeeze or tilt of the trigger at its bottom portion will cause the gun to activate to clinch the hog ring. The design of the present tool handle and trigger mechanism is intended to reduce the detrimental effects encountered by operators of prior art hog ring tools that are generally held in the front of the handle by three fingers with one trigger finger. With the new design of the handle and trigger mechanism of this invention, the tool can be held and gripped with all the fingers of the hand and can be triggered by squeezing all the fingers of the hand or by pushing the tool against the workpiece with one's whole arm and depressing the bottom portion of the trigger by only minor palm movement when it is desired to activate the tool. This feature reduces the harmful effects of operating a tool requiring one-finger trigger activation.

Although the present invention has been described with reference to particular embodiments, it will be apparent to those skilled in the art that variations and modifications can be substituted therefor without departing from the principles and spirit of the invention.

I claim:

1. A pneumatic hog ring gun operating on air pressure from a compressed air source having a main air line, said hog ring gun having a front and a rear, said hog ring gun for the individual application of a plurality of hog rings, comprising:

a frame having a front and rear;

first and second side plates extending from the front of said frame, said first and second side plates each having an upper and a lower bolt hole defined respectively therein and pivot means disposed in said upper and lower bolt holes;

a main piston chamber defined in the rear of said frame, said main piston chamber having a front and a rear;

a main piston disposed in said main piston chamber;

a shaft having a first end, a second end, and a longitudinal axis, said first end attached to said main piston;

a first air inlet defined in said main piston chamber at its front and a second air inlet defined in said main piston chamber at its rear;

means to direct at selected times said compressed air from said main air line through said first air inlet aperture into said main piston chamber, said main piston thereby being forced rearwards at such selected times;

a power wedge having a height, a front end, a rear end, a top surface, and a bottom surface, said rear end of said power wedge attached to said second end of said shaft so that said power wedge moves, respectively, backwards or forwards with backward or forward movement of said main piston;

an upper jaw having a front end and a rear end, said upper jaw having an upper jaw bolt hole defined therein with said pivot means positioned therein through said upper bolt holes defined in said first and second side plates, said upper jaw having an inwardly curved surface running from said rear end to near said upper jaw bolt hole, said curved surface facing downward, said upper jaw having a clinching surface at its front end, said clinching surface facing downward;

a lower jaw having a front end and a rear end, said lower jaw having a lower jaw bolt hole defined therein with said pivot means positioned therein through said lower bolt holes defined in said first and second side plates, said lower jaw having an inwardly curved surface running from said rear end to near said lower jaw bolt hole, said curved surface facing upward corresponding in position to said curved surface of said upper jaw, said curved surfaces of said upper and lower jaws being spaced apart at their rear ends a distance less than the height of said power wedge, said lower jaw having a clinching surface at said front end, said lower jaw clinching surface facing upward corresponding in position to said clinching surface of said upper jaw;

said upper and lower jaws disposed in line with said longitudinal axis of said shaft, said curved surfaces of said upper and lower jaw disposed, respectively, above and below said power wedge with the distance between said first ends of said upper and lower jaws being less than the height of said power wedge whereby as said power wedge moves backward, said top and bottom surfaces of said power wedge contact said corresponding curved surfaces of said upper and lower jaws, spreading said curved surfaces apart and pivoting said jaws about their respective jaw bolt holes, thereby forcing said clinching surfaces of said second ends together to clinch a hog ring contained therebetween;

a lock piston chamber defined within said frame to the rear of said upper and lower jaws;

a lock piston having a center, said lock piston disposed within said lock piston chamber, said lock piston having an aperture defined in its center, said shaft passing through said lock piston chamber and through said aperture in said lock piston, said lock piston when in its full forward position extending out of said front of said frame and contacting said rear ends of said upper and lower jaws and wedging said rear ends of said upper and lower jaws apart, causing said upper and lower jaws to pivot about said pivot means and to bring said clinching surfaces toward one another, said clinching surfaces thereby holding a hog ring securely therebetween, whereby said securely held hog ring can be used to pull workpieces together before their actually being clinched;

a handle attached to said frame;

a first air line disposed in said handle, said first air line having a first end and a second end, said first end of said first air line attached to said main air line;

a second air line disposed in said handle, said second air line having a first end and a second end, said first end of said second air line in communication with said first air line;

a trigger valve positioned on said second air line to stop air flow through said second air line when activated;

a trigger positioned on said handle to activate said trigger valve when manually depressed;

a main piston valve chamber defined in said frame at said second end of said first air line;

a lock piston chamber air passage defined in said frame at said second end of said first air line, said lock piston chamber air passage in communication with said main piston valve chamber;

said first air inlet extending from said main piston valve chamber to said main piston chamber;

a lock piston air inlet extending from said lock piston chamber air passage to said lock piston chamber;

a lock piston valve disposed in said lock piston chamber air passage, said lock piston valve having a portion extending out of said frame, said lock piston valve having a first and a second position, said lock piston valve actuatable to block said lock piston air inlet in said first position, and in said second position to leave said lock piston chamber air passage open;

a main piston valve having a diameter, said main piston valve disposed in said main piston valve chamber, said main piston valve having a front, a rear and a first and second position, said main piston valve when in said first position causing said front of said main piston valve to block said first air inlet, and when in said second position leaving said first air inlet open;

an air receipt chamber defined in said frame, said air receipt chamber in communication with said second end of said second air line;

a floating valve piston having a diameter and positioned in said air receipt chamber, said floating valve piston to movably engage said rear of said main piston valve;

a floating regulator valve having a front and a rear, said floating regulator valve positioned in said air receipt chamber, said floating regulator valve having a first position and a second position, said floating regulator valve when in said first position allowing air pressure to enter said second air inlet to the rear of said main piston chamber and when in said second position preventing air pressure from entering said second air inlet in said rear of said main piston chamber;

a lock piston valve actuator lever having a front, a rear, a first end disposed at said rear of said lock piston valve actuator lever, a second end disposed at said front of said lock piston valve actuator lever, and a bolt hole defined in said lock piston valve actuator lever, said first end having a lock piston valve pressure surface, said second end curving upward to a position higher than said bolt hole and having a power wedge pressure surface, said lock piston valve actuator lever further including a portion running from said first end to a point near said bolt hole forming an inwardly curved surface, said curved surface facing upward, said lock piston valve actuator lever pivotably secured by said second pivot member through a lock piston valve actuator lever bolt hole defined therein and said aligned lower bolt holes of said lower jaw and of said first and second side plates, said second end of said lock piston valve actuator lever disposed in front of said power wedge, said first end of said lock piston valve actuator lever disposed above said portion of said lock piston valve extending out of said frame, said curved surface of said lock piston valve actuator lever disposed below said power wedge, said first end of said lock piston valve actuator lever positioned above said bottom of said power wedge, whereby as said power wedge moves rearward, said bottom surface contacts said curved surface of said lock piston valve actuator lever, pushing down said curved surface and pivoting said lock piston valve actuator lever about said pivot member, and as said lock piston valve actuator lever pivots to its second position, said lock piston valve pressure surface contacts said extended portion of said lock piston valve extending from said frame, pushing said lock piston valve rearward and thereby closing said lock piston valve and blocking air pressure to said lock piston chamber, and upon said power wedge returning to its forward first position, said power wedge contacts said power wedge pressure surface of said lock piston valve actuator lever, pivoting said lock piston valve actuator lever back to its first position moving said lock piston valve pressure surface off said lock piston valve, allowing said lock piston valve to be opened by the air pressure in said lock piston chamber air passage thereby also allowing said air pressure through said lock piston air inlet into said lock piston chamber;

a feed blade having a first end and a second end, said second end disposed toward said front of said hog ring gun, said first end attached to said front end of said power wedge opposite said second end of said shaft so that said feed blade moves backwards and forwards, respectively, with said backward and forward movement of said power wedge, said second end of said feed blade extending between said upper and lower jaws behind said clinching surfaces of said upper and lower jaws;

a hog ring feed bar having a first end and a second end, said plurality of hog rings being mounted thereon at said first end;

means to position a hog ring from said feed bar to a position in front of said feed blade, whereby when said trigger is not activated, said air pressure passes through both first and second air lines such that the air pressure in said first air line passes into said lock piston chamber by said lock piston valve and through said lock piston air inlet into said lock piston chamber, urging said lock piston to wedge apart said rear ends of said upper and lower laws while at the same time air pressure in said second air line passes into said air receipt chamber, forcing said floating valve piston against the rear of said main piston valve, moving said main piston valve frontwards to block said first air inlet while at the same time causing air pressure to pass through said floating regulator valve being in its first position to pass in through said second air inlet in the rear of said main piston chamber to move said main piston forward, and when said trigger on said handle is activated, said trigger valve stops air flow in said second air line, thereby releasing pressure in said air receipt chamber and allowing said main piston valve to then be forced rearward by the pressure in said first air line to expose said first air inlet, allowing air pressure to enter the front of said main piston chamber and driving said main piston rearward, such that said power wedge moves said rear ends of said upper and lower jaws apart to clinch said hog ring while at the same time the bottom surface of said power wedge pushes down said curved surface of said lock piston valve actuator lever, causing its lock piston valve pressure surface to push said lock piston valve rearward to close said lock piston air inlet to release forward pressure on said lock piston.

2. The hog ring gun of claim 1 further including:

a third outlet located at the rear of said main piston chamber;

a shutoff air chamber defined in said frame into which said third outlet directs air pressure;

a floating regulator valve piston disposed on said rear of said floating regulator valve, said regulator valve piston positioned in said shutoff air chamber, said floating regulator valve having at its front a floating regulator valve tip; and a regulator valve baffle having an aperture defined therein, said regulator valve baffle positioned in said air receipt chamber at the front of said floating regulator valve, said floating regulator valve tip disposed in said regulator valve baffle aperture such that when air pressure passes into said air receipt chamber, it passes through said regulator valve baffle aperture by said floating regulator valve tip and through said second air inlet in said main piston chamber until a preselected air pressure is reached, such air pressure passing through said third outlet into said shutoff air chamber to apply pressure against said floating regulator piston which pressure moves said floating regulator piston forward such that said floating regulator valve tip blocks said aperture in said regulator valve baffle to prevent further air pressure from passing therethrough and through said second air inlet into said main piston chamber.

3. The hog ring gun of claim 2 further including an adjustable stop member positionable at alternative positions in the rear of said main piston chamber.

* * * * *